US011832676B2

(12) United States Patent
Nassimi

(10) Patent No.: US 11,832,676 B2
(45) Date of Patent: Dec. 5, 2023

(54) AIR PRESSURE OPERATED VARIABLE AIR VENT FOR HELMET

(71) Applicant: Shary Nassimi, Malibu, CA (US)

(72) Inventor: Shary Nassimi, Malibu, CA (US)

( * ) Notice: Subject to any disclaimer, the term of this patent is extended or adjusted under 35 U.S.C. 154(b) by 5 days.

(21) Appl. No.: 17/321,007

(22) Filed: May 14, 2021

(65) Prior Publication Data

US 2022/0361621 A1 Nov. 17, 2022

(51) Int. Cl.
*A42B 3/24* (2006.01)

(52) U.S. Cl.
CPC ..... *A42B 3/24* (2013.01)

(58) Field of Classification Search
CPC ..... A42B 3/28; A42B 3/223; A42B 3/222; A42B 3/221; A42B 3/283; A42B 3/326; A42B 3/0493
USPC ..... 2/6.5
See application file for complete search history.

(56) References Cited

FOREIGN PATENT DOCUMENTS

| | | | | |
|---|---|---|---|---|
| FR | 2402455 | * | 4/1979 | ..... A63B 71/10 |
| WO | WO-9528100 A1 | * | 10/1995 | ..... A42B 3/222 |

OTHER PUBLICATIONS

Translation of FR-2402455 (Year: 1979).*

* cited by examiner

*Primary Examiner* — Katherine M Moran
*Assistant Examiner* — Grady Alexander Nunnery
(74) *Attorney, Agent, or Firm* — Bond Schoeneck & King PLLC; David L. Nocilly

(57) ABSTRACT

A helmet with an automatic vent that is normally open and responds to external air pressure to close. The vent is pivotally mounted to the body of the helmet to move between a closed position, wherein the vent does not permit any flow of air into the cavity of the body, and an open position, wherein the vent allows the flow of air into the cavity of the body. A spring provides a biasing force that urges the vent into the open position. The biasing force provided by the spring is overcome by air pressure on the vent when the helmet is in motion so that the vent closes. The vent may be a windshield that closes when the user travels at a predetermined velocity and opens when the user is stationary, thereby avoiding the need for the user to manually open and close the vent.

9 Claims, 5 Drawing Sheets

AIR PRESSURE OPERATED VARIABLE AIR VENT FOR HELMET

BACKGROUND OF THE INVENTION

1. Field of the Invention

The present invention related to helmets and, more specifically, to air pressure operated vent that can automatically adjust the amount of air provided to the wearer of the helmet depending on the speed of travel.

2. Description of the Related Art

Conventional helmets address the need for proper and adequate airflow by installing vents on the front, top and/or rear of the helmet. The vents are designed to provide airflow once the wearer travels at a high enough speed to provide the needed flow. These vents generally have a slide which can be manually used to open or close the vent. Most helmets have existing vents on the front and back (or on top facing back) of the helmets. The design is generally created so that the user sets an opening of desired size, and when the wearer moves, air flows through the front, carry through the helmet and exit from the rear or rear-facing vents. These types of vents are adequate when the wearer is traveling at a high rate of speed. However, when the wearer is moving slowly or is stopped, the vents provide very little air flow. The wearer must then manually open the visor or windshield in order to receive air and then manually close the visor when moving at a faster speed and needs the visor for protection against the wind.

For example, in warm weather, the wearer must open the visor (which is the windshield) when not moving in order to provide sufficient cool air for breathing. In cold weather, the lack of airflow causes fogging of the interior of the helmet and windshield and thus can lead to extremely dangerous conditions until the wearer is moving fast enough so that the airflow defogs the windshield. As are result, in both warm and cold weather conditions, the wearer is forces to manually operate the windshield visor repeatedly to adjust for current conditions, and must do so while negotiating traffic and each time the wear goes from speed to stop, and vice versa. For example, when the wearer is riding a motorcycle, the wearer must remove a hand from the handlebars and reach up to open the helmet windshield when stopped and then, once traveling fast enough, again remove their hand from the handlebar to close the windshield. This repeated release of the handlebars and overall distraction can cause a possible loss of control of the motorcycle. Additionally, the fogging that occurs on cooler days and lack of fresh air on hot days is constant difficult faced by motorcycle riders.

Existing approaches to this problem involve fan powered airflow systems for the battery replacements or recharging as well as anti-fog surface treatments that only last a short time or are otherwise ineffective when there is an extensive amount of humidity. Accordingly, there is a need in the art for an approach that can provide the desired amount of vent and moisture control on a regular basis with little or no wearer interaction and without requiring complex powered systems or ineffective chemical treatments.

BRIEF SUMMARY OF THE INVENTION

The present invention overcomes the inconvenience, discomfort and safety issues associated with helmets by automatically adjusting the air flow into the helmet in order to provide temperature regulation, breathing air supply, exhale exhaust, and moisture control according to the movement of the wearer. More specifically, the present invention comprises a helmet with an automatic vent that is biased to be normally open and responsive to a predetermined increase in external air pressure to close. The helmet includes a body defining a cavity therein in which the head of a user may be positioned. A vent is pivotally mounted to the body for movement between a closed position, wherein the vent limits or prevents flow of air into the cavity of the body, and an open position, wherein the vent allows the flow of ample air into the cavity of the body. A spring coupled is between the body and the vent to provide a biasing force that urges the vent into the open position. The biasing force provided by the spring is configured to be overcome by a predetermined amount of air pressure on the vent so that the vent closes when movement of the user results in the predetermined amount of air pressure on the vent. The vent may be a windshield and the spring may be adjustable to attenuate the amount of bias so that the windshield closes when the user travels at a predetermined velocity and opens when the user is stationary. The spring may comprise a torsion spring that is positioned inside of a pivotal mount that couples to the vent to the body. The biasing force provided by the spring may be adjusted by rotating a knob associated with the pivotal mount. The spring may also comprise an elongated spring extending between the body and the vent and coupled to the body via a slider than can be moved to adjust the amount of biasing force provided by the spring. The movement of the air pressure operated parts maybe mediated using a dampener, such as a friction method, or oil or air filled shock unit or any other means of preventing flutter and allowing for smoother operation of the vent or windshield.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
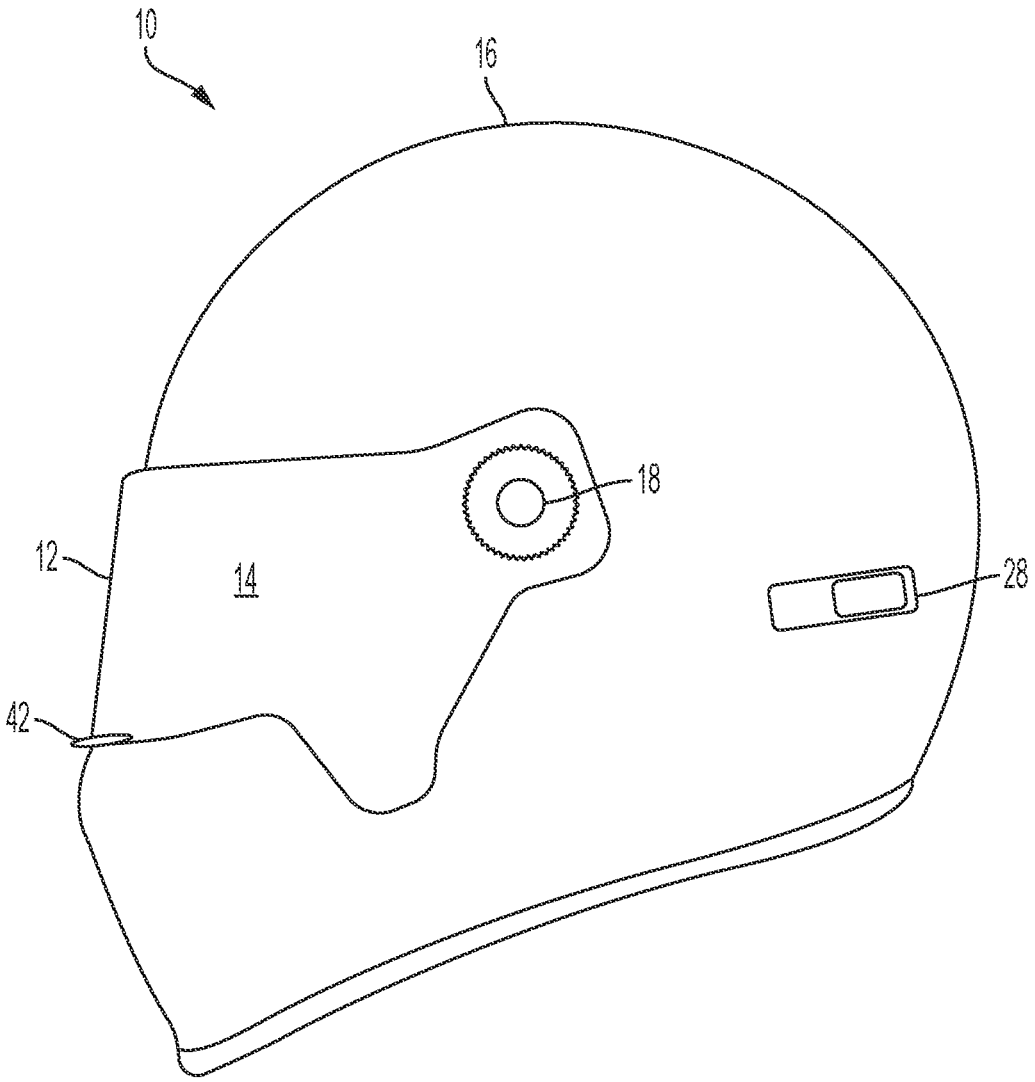
FIG. 1 is a side view of a helmet according to the present invention with a pivotal windshield in the closed position.
Figure 2:
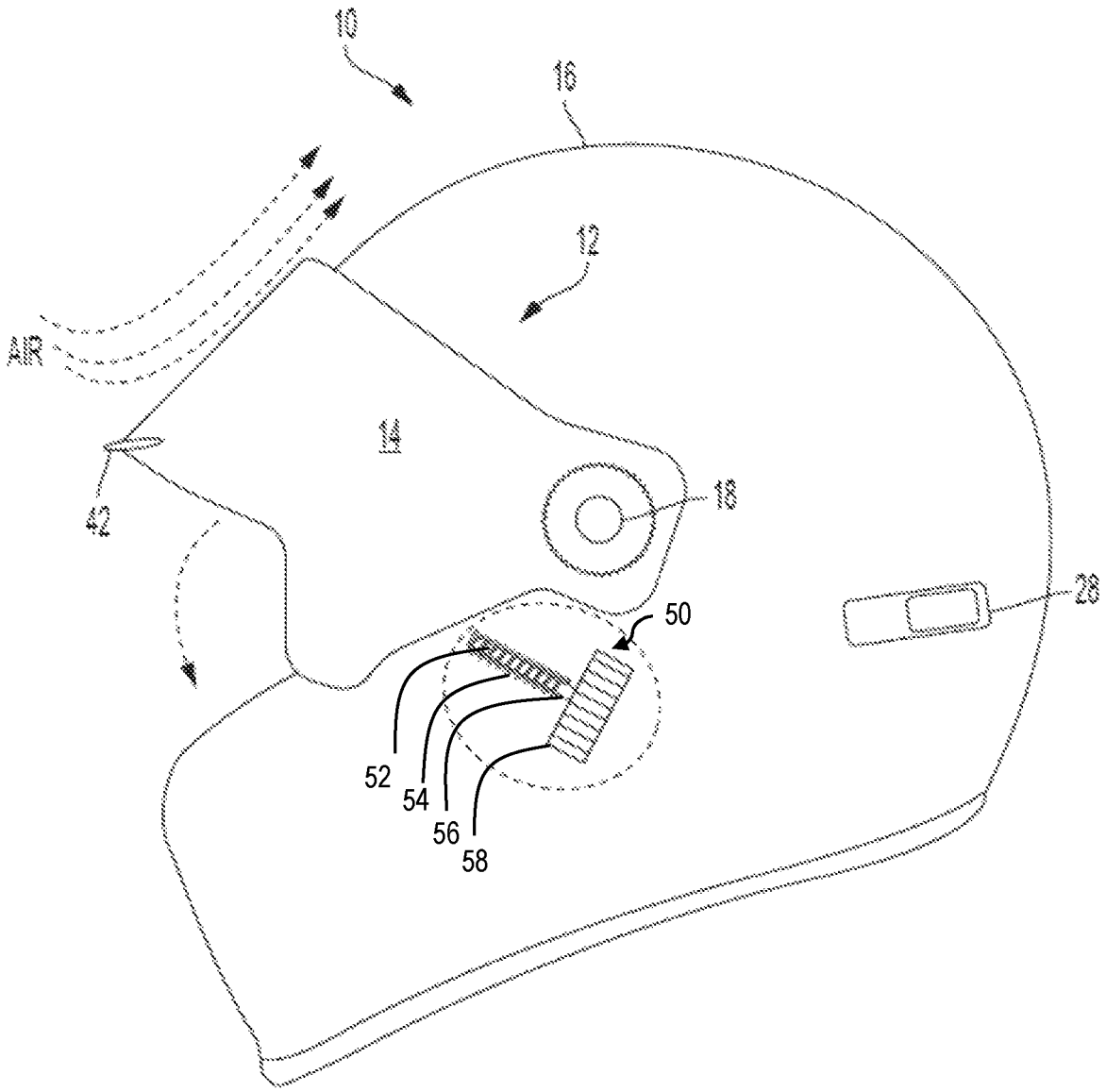
FIG. 2 is a side view of a helmet according to the present invention with a pivotal vent in the open position.

Referring to the figures wherein like numerals refer to like parts throughout, there is seen in FIG. 1, a helmet 10 including an air pressure operated variable air vent 12 according to the present invention. In a first embodiment, air vent 12 comprises a windshield 14 pivotally coupled to the body 16 of helmet 10 by a pivot 18 for movement between a closed position, as seen in FIG. 1, and an open position, as seen in FIG. 2. In a first embodiment, air vent 12 comprises a transparent windshield 14 is biased into an open position using an adjustable amount of biasing force that will be overcome by a positive differential air pressure that develops on the exterior of air vent 12. In this circumstance, air vent 12 will close against the biasing force when sufficient air pressure is developed, such as when the user of helmet 10 travels at velocity and air flows over helmet 10. As a result, windshield 14 will open when the user is stationary or at low velocity into an open position (as seen in FIG. 2) and will close in response to movement of the user at higher velocities when the air flow overcomes the biasing force into a closed position (as seen in FIG. 1). In this manner, air vent 12 will automatically increase the amount of venting to helmet 10 when the user is stationary and will reduce the amount of venting when the user is traveling at higher velocities.

Figure 3:
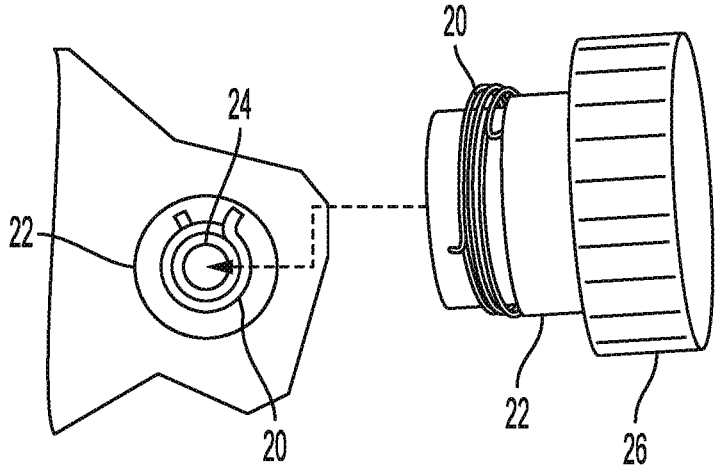
FIG. 3 is a partial exploded view of a torsion spring an pivotal mount for a vent according to the present invention.

Referring to FIG. 3, pivot 18 may include a torsion spring 20 that engages body 16 and windshield 14 via concentric coupling elements 22 and 24 within pivot 18 to provide the biasing force. Pivot 18 may further be adjustable to control the amount of force applied to windshield 14 by spring 20 such as by rotating one coupling element 22 or 24 relative the other coupling element 22 or 24. For example, a large user knob 26 that extends from body 16 and is secured to coupling element 22 may be rotating to change the relative positioning of coupling elements 22 and 24 and thus the bias force provided by spring 20 extending there between. As a result, a user can rotate knob 26, for example even when wearing gloves, to adjust the amount of force provided by spring 20. When user of helmet 10 is stopped, the bias force of spring 20 is configured to force windshield 14 into the open position. As user of helmet 10 begins moving and then increases velocity, the pressure of air flowing over windshield 14 will increase with the increase in velocity until the force provided by the air pressure overcomes the bias of spring 20, thereby causing windshield 14 to close. When user of helmet 10 slows down or stops, the biasing force of spring 20 will overcome the air pressure on windshield 14, thereby opening windshield 14. Air vent 12 will therefore automatically open when user is stopped or moving slowly, and will close at higher speeds. As a result, windshield 14 opens to improve air flow when stopped (and provide more cooling or prevent fogging) and closes automatically when traveling at higher speeds (to protect user against winds) so that the user does not have to manually open and close windshield 14 and experience dangerous conditions.

As is known in the art, helmet 10 may include detents for retaining windshield in specific positions, provided the detents are positioned only for fully opened and fully closed positions while allowing for the automatic opening and closing there between, or the detents can be overcome by the bias force of spring 20 or 30 and the pressure of air flowing over helmet 10 so that detents do not interfere with the operation of the present invention. Standard adjustable vents 28 may be included in the rear of helmet 10 to enhance or moderate the venturi effect and air pressure differential between the air pressure that forms on windshield 14 and the interior of helmet 10 to ensure that windshield 14 opens and closes at the desired velocity changes. Standard adjustable vents 28 may also be included in other location to provide additional airflow.

Figure 4:
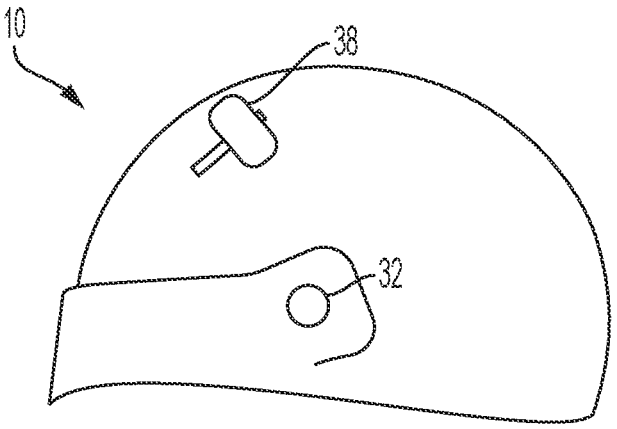
FIG. 4 is an exterior side view of a helmet having a spring and slider according to the present invention.
Figure 5:
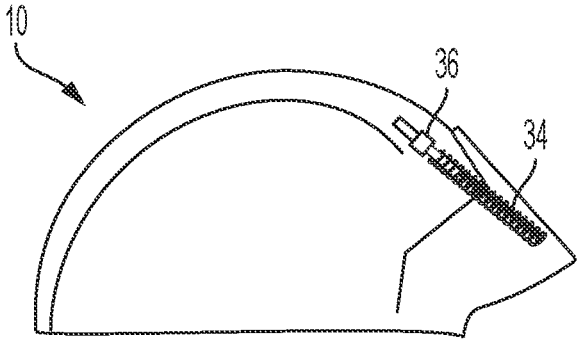
FIG. 5 is an interior side view of a helmet having a spring and slider according to the present invention.

Referring to FIGS. 4 and 5, in another embodiment, air vent 12 may include a standard pivot mount 32 and be biased by a spring 34 that extends between body 16 and windshield 14 in a different location than the pivoting location. Preferably, spring 34 is adjustable regardless of where it is located, such as by using a slider 36 coupled one end of spring 34 and being moveable in body 16 in response to movement of an external knob 38 so that a user can adjust the amount of bias force provide by spring 30.

In yet another embodiment, air vent 12 may be biased into the open position yet closable in response to external air pressure using other biasing approaches. For example, air vent 12 can be responsive to gravity, such as by using a counterweight selected according to the amount of air pressure that will develop over air vent 12 when transitioning to faster velocities so that air vent 12 will close automatically. Air vent 12 may also include a pneumatic or hydraulic piston whose force can be overcome by external air pressure at higher velocities.

In all embodiments, helmet 10 may additionally include a latch that be used to override the operation of air vent 12 so that the windshield can be held in closed, open or partially open position if desired regardless of the movement of user. Helmet 10 may also include a dampening mechanism so that the movement of air vent 12 is not too abrupt.

Figure 6:
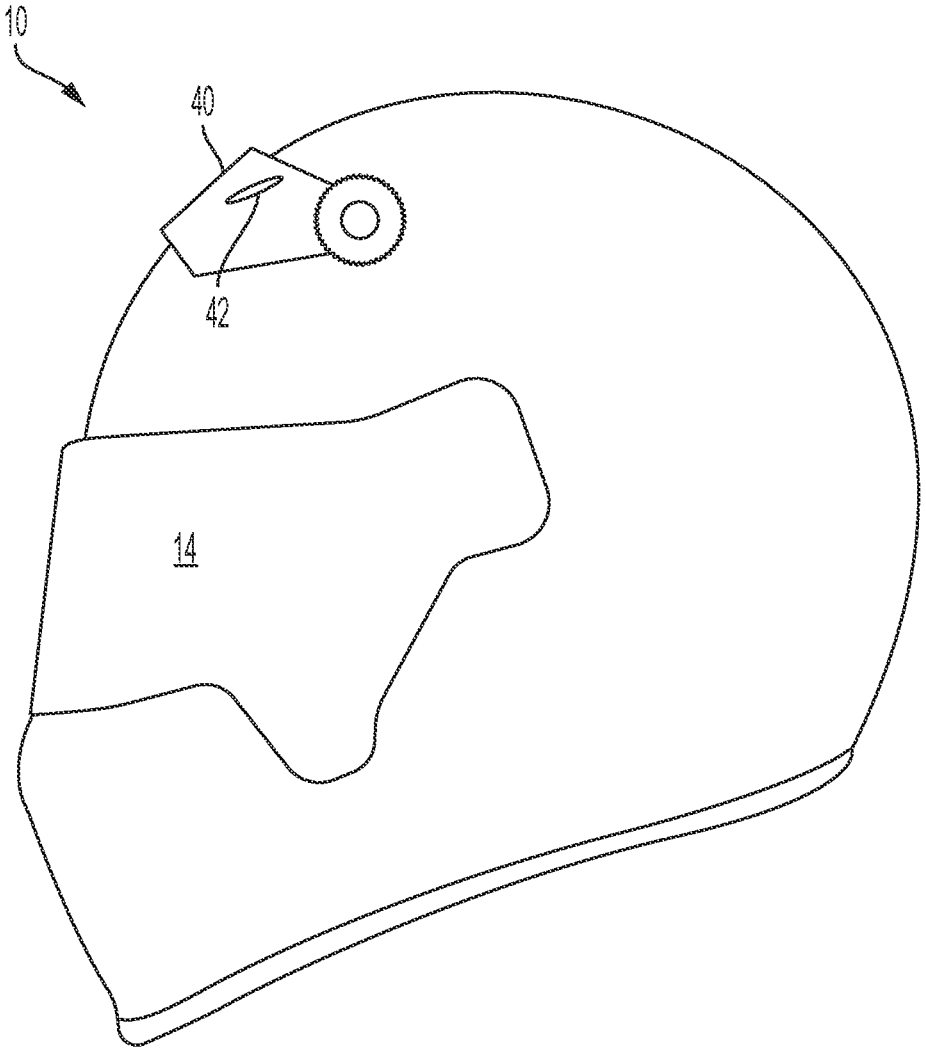
FIG. 6 is a side view of a helmet having a pivotal vent separate from the windshield according to the closed position.

Referring to FIG. 6, air vent 12 does not need to be windshield 14 and could be a dedicated vent 40 that is positioned elsewhere other than in front of the eyes of a user of helmet 10. Helmet 10 may also include multiple air vents 12 including combinations of windshield 14 that is automatically opened and closed in addition to additional air vents 12 that are not configured as windshields. Air vent 12 of helmet 10 may also include one or more winglets 42 extending from air vent 12 and oriented to enhance the amount of air pressure imparted to air vent 12 to ensure closing of air vent 12 when a user is in motion if the location of air vent 12 does not result in sufficient air pressure to close air vent 12 when desired.

As further seen in FIG. 2, helmet 10 may additionally include a dampener 50 that slows movement of air vent 12 into the closed position so that vent 12 does not snap shut suddenly when motion of the user achieves sufficient air pressure to close vent 12 and to prevent fluttering. For example, dampener may include a rod 52, a spring 54, and a stop 56 along with an adjustment wheel 58 that can be rotated by a user to adjust the amount of dampening force provided by dampener 50 to vent 12. Dampener 50 may be mounted inside helmet 10 with wheel 58 accessible to a user either internally or externally. It should be recognized that dampener 50 could comprise other dampening structure, such as one or more pneumatic cylinders, and be incorporated into the structure that providing the biasing force to vent 12. For example, spring 34 that extends between body 16 and windshield 14 in a different location than the pivoting location, as seen in FIG. 5, could comprise a pneumatic cylinder or gas spring.

What is claimed is:

1. A helmet with air pressure operated venting, comprising:

a body defining a cavity therein;

a vent pivotally mounted by a first coupling element to the body for movement between a closed position, wherein the vent is configured to allow a first predetermined amount of flow of air into the cavity of the body, and an open position, wherein the vent is configured to allow a second predetermined amount of flow of air into the cavity of the body that is more than the first predetermined amount;

a knob extending from the body and secured to a second coupling element that is concentric with the first coupling element;

a spring extending between the second coupling element of the knob and the first coupling element of the vent to provide a biasing force that urges the vent into the open position; and wherein the knob is rotatable to change the relative positioning of the first coupling element and the second coupling element such that the biasing force provided by the spring is changed.

2. The helmet of claim 1, wherein the vent comprises a windshield.

3. The helmet of claim 2, wherein the biasing force provided by the spring is configured to be overcome by a predetermined amount of air pressure on the vent.

4. The helmet of claim 3, wherein the predetermined amount of air pressure on the vent is achieved when the helmet is in motion.

5. The helmet of claim 4, wherein the spring comprises a torsion spring.

6. The helmet of claim 4, wherein the spring comprises an elongated spring extending between the body and the vent.

7. The helmet of claim 1, further comprising a dampener coupled between the cavity and the vent that is configured to mediate movement of the vent.

8. The helmet of claim 1, where the vent includes at least one winglet to increase an amount of pressure applied to the vent by a flow of air over the vent relative to the absence of the at least one winglet.

9. A method of automatically venting a helmet, comprising the steps of:

providing a body defining a cavity therein and a vent pivotally mounted by a first coupling element to the body for movement between a closed position, a knob extending from the body and secured to a second coupling element that is concentric with the first coupling element, a spring extending between the second coupling element of the knob and the first coupling element of the vent to provide a biasing force that urges the vent into the open position, wherein the vent allows a first predetermined amount of flow of air into the cavity of the body, and an open position, wherein the vent allows a second predetermined amount of flow of air into the cavity of the body that is more than the first predetermined amount;

moving the vent from the open position to the closed position if the body of the helmet is in motion;

moving the vent from the closed position to the open position if the body is not moving; and rotating the knob to change the relative positioning of the first coupling element and the second coupling element such that the biasing force provided by the spring when urging the vent into the open position is changed.

* * * * *